US007735545B2

(12) United States Patent
Chow

(10) Patent No.: US 7,735,545 B2
(45) Date of Patent: Jun. 15, 2010

(54) SYSTEM AND APPARATUS FOR NON-POWERED CLEANING OF TUBULAR HEAT EXCHANGE SYSTEMS

(75) Inventor: Kok Heng Alex Chow, Singapore (SG)

(73) Assignee: Hydroactive Veloball International, Singapore (SG)

( * ) Notice: Subject to any disclaimer, the term of this patent is extended or adjusted under 35 U.S.C. 154(b) by 258 days.

(21) Appl. No.: 11/572,208

(22) PCT Filed: Jul. 17, 2005

(86) PCT No.: PCT/SG2005/000195

§ 371 (c)(1),
(2), (4) Date: Jan. 16, 2007

(87) PCT Pub. No.: WO2006/009515

PCT Pub. Date: Jan. 26, 2006

(65) Prior Publication Data

US 2007/0204973 A1 Sep. 6, 2007

(30) Foreign Application Priority Data

Jul. 16, 2004 (SG) ..... 200403902-0

(51) Int. Cl.
*F28G 1/12* (2006.01)

(52) U.S. Cl. ..... 165/95; 165/94

(58) Field of Classification Search ..... 165/94, 165/95; 210/512.1, 512.2
See application file for complete search history.

(56) References Cited

U.S. PATENT DOCUMENTS 3,841,397 A * 10/1974 Eimer ..... 165/95
3,939,065 A * 2/1976 Einarsson Ahlfors ..... 209/240
4,420,038 A * 12/1983 Okouchi et al. ..... 165/95
4,498,932 A * 2/1985 Kruka ..... 134/8

(Continued)

FOREIGN PATENT DOCUMENTS

SU 1 703 208 * 7/1992

OTHER PUBLICATIONS

WO 2006/009515, International Search Report and Written Opinion of International Searching Authority for PCT/SG2005/00195.

*Primary Examiner*—Theresa J Walberg
(74) *Attorney, Agent, or Firm*—Intellectual Property Law Group LLP; Juneko Jackson; Otto O. Lee

(57) ABSTRACT

In the present invention, a dual hull cyclone is incorporated into a non-powered cleaning system using balls for tubular heat exchange systems. The dual hull cyclone separates balls which are smaller than a predetermined diameter so that they can be disposed of and replaced. The dual hull cyclone also serves to separate debris from fluid in the tubular heat exchange system and also debris that may have accumulated on the balls. The cleaning system in accordance with the present invention comprises a plurality of balls circulating in the fluid of the heat exchange system, a ball inlet, a ball outlet, and a dual hull cyclone. The balls in the fluid are generally of a predetermined diameter suitable for cleaning the tubes in the heat exchange unit. While the balls may be made of a variety of elastomeric materials, almost any resilient material may be utilized. Furthermore, the balls used in the present invention utilize a asymmetrical weighted core to increase the specific gravity of the balls.

24 Claims, 6 Drawing Sheets

U.S. PATENT DOCUMENTS 4,554,965 A * 11/1985 Bochinski et al. ..... 165/95
4,569,097 A * 2/1986 Echols ..... 15/104.061
5,388,636 A * 2/1995 Peery ..... 165/95
5,482,111 A * 1/1996 Bizard ..... 165/95

* cited by examiner

SYSTEM AND APPARATUS FOR NON-POWERED CLEANING OF TUBULAR HEAT EXCHANGE SYSTEMS

CROSS-REFERENCE TO RELATED APPLICATIONS

This application is a U.S. National Phase application, under 35 U.S.C. §371, of International Application no. PCT/SG2005/000195, with an international filing date of Jun. 16, 2005 and claims priority to Singapore application no. 200403902-0, filed Jul. 16, 2004; all of which are hereby incorporated by reference for all purposes.

FIELD OF THE INVENTION

The present invention generally relates to cleaning systems for tubular heat exchange systems. In particular, the invention relates to a non-powered system and apparatus for circulation of balls for cleaning tubular heat exchange systems.

BACKGROUND OF THE INVENTION

Tubular heat exchange systems are used throughout different industries and examples of which are condensers of turbines, refrigeration units, heat exchangers in gas cooling systems and scrubbing systems. They are also used in power plants, desalination modules and petrochemical industries. These tubular heat exchange systems typically use a fluid circulating through several tubes bundled together for the heat exchange. The operations of such heat exchange systems are well-known in the art and will not be discussed in detail.

Invariably, maintenance of these tubes is necessary for efficient heat exchange. Debris and fouling deposits as a result of precipitation, corrosion, crystallization and chemical reactions within the tubular heat exchange systems can clog up the tubes. Traditional methods of cleaning these tubes require the shutting down of the heat exchange system, taking it off-line and physically flushing the individual tubes.

New cleaning systems have been developed using elastomeric balls in the fluid circulating in the tubes of the heat exchange system. A number of balls circulating in the heat exchange system will result in the balls passing through at least a certain number of the tubes. As the balls pass through the tubes, any fouling deposits or debris in the tubes are often pushed out. This new cleaning method has proven to be relatively effective in reducing the frequency of shutting down the heat exchange system for maintenance. Such systems have become well-known and an example of which is disclosed in U.S. Pat. No. 5,592,990.

In such tube cleaning systems using circulating balls, a means for separating the balls from the heat exchange system is essential. The elastomeric balls are worn out after a certain period of time and the cleaning efficiency may be decreased as the balls are too small to effectively remove fouling deposits from the tubes. The worn-out balls need to be collected and separated from the heat exchange system so that new balls may be introduced. In U.S. Pat. No. 5,592,990, a ball collector housing is used to collect the balls and separate them from the fluid, omitting a separate reservoir for introducing balls into the system. However, it is an all-or-nothing approach as even balls that are not worn-out are also collected and disposed of.

In U.S. Pat. No. 4,974,662, a ball separator is used to classify the balls according to different predetermined sizes by using openings bounded by crests of parallel rails. The separated worn-out balls are then collected in a basket for removal. While only the worn-out balls are separated from the fluid, use of a drive pump is required to provide sufficient pressure such that the balls can be forced through the ball separator.

At present, there is still a lack of a non-powered cleaning system using balls for cleaning tubes in heat exchange system with an efficient and effective means for separating worn-out balls from the fluid.

SUMMARY OF THE INVENTION

The present invention seeks to provide a non-powered system and apparatus for circulation of balls for cleaning tubular heat exchange systems.

Accordingly, in one aspect, the present invention provides, a non-powered cleaning system for cleaning a plurality of tubes in a heat exchange system having an inlet end and a discharge end, where a fluid is used as a heat exchange medium, the fluid flowing from the inlet end into the plurality of tubes to the discharge end, the cleaning system comprising: a plurality of balls in the fluid; a ball inlet coupled to the discharge end for introducing the fluid and the plurality of balls into the cleaning system; a ball divertor unit coupled to the ball inlet for directing the plurality of balls and fluid into the ball inlet; a dual hull cyclone coupled to the ball inlet for separating a plurality of balls below a predetermined diameter from the plurality of balls, the dual hull cyclone further for separating debris from the fluid; and a ball outlet coupled to the dual hull cyclone for introducing the plurality of balls after separation and fluid into the inlet end of the heat exchange system;

wherein the dual hull cyclone comprises a primary cyclone and a secondary cyclone; the secondary cyclone adapted to have a plurality of apertures of a predetermined shape and size and the secondary cyclone further being disposed within the primary cyclone.

In another aspect, the present invention provides, a dual hull cyclone for separating balls below a predetermined diameter from a plurality of balls in a cleaning system for cleaning a plurality of tubes in a heat exchange system, where a fluid is used as a heat exchange medium, the dual hull cyclone comprising: a primary cyclone; a secondary cyclone disposed within the primary cyclone and having a plurality of apertures of a predetermined shape and a predetermined size; a primary inlet for directing fluid tangentially into the primary cyclone; and a secondary inlet for directing fluid containing the plurality of balls tangentially into the secondary cyclone; wherein the secondary cyclone is for separating balls below a predetermined diameter from the plurality of balls by allowing the balls below the predetermined diameter to pass through the plurality of apertures into the primary cyclone.

In yet another aspect, the invention provides, a method for separating a plurality of balls below a predetermined diameter from a plurality of balls in a tube cleaning system, using a dual hull cyclone having a primary cyclone, a secondary cyclone disposed within the primary cyclone and having a plurality of apertures of a predetermined shape and a predetermined size; wherein the secondary cyclone allows the plurality of balls below the predetermined diameter to pass through the plurality of apertures into the primary cyclone, the method comprising the steps:

a) introducing fluid into the primary cyclone, and introducing fluid containing the plurality of balls into the secondary cyclone;

b) forming a primary fluid vortex in the primary cyclone, and forming a secondary fluid vortex in the secondary cyclone; and c) separating the plurality of balls below the predetermined diameter from the secondary cyclone into the primary cyclone;

wherein the primary fluid vortex is of a higher velocity than the secondary fluid vortex, and pressure differential between the primary fluid vortex and the secondary fluid vortex enhances the separation of the plurality of balls below the predetermined diameter.

BRIEF DESCRIPTION OF THE DRAWINGS

A preferred embodiment of the present invention will now be more fully described, with reference to the drawings of which.

DETAILED DESCRIPTION OF THE INVENTION

In the present invention, a dual hull cyclone is incorporated into a non-powered cleaning system using balls for cleaning tubular heat exchange systems. The dual hull cyclone separates worn-out balls which are smaller than a predetermined diameter so that they can be disposed of and replaced. The dual hull cyclone also serves to separate debris from fluid in the tubular heat exchange system and also debris that may have accumulated on the balls.

Figure 1:
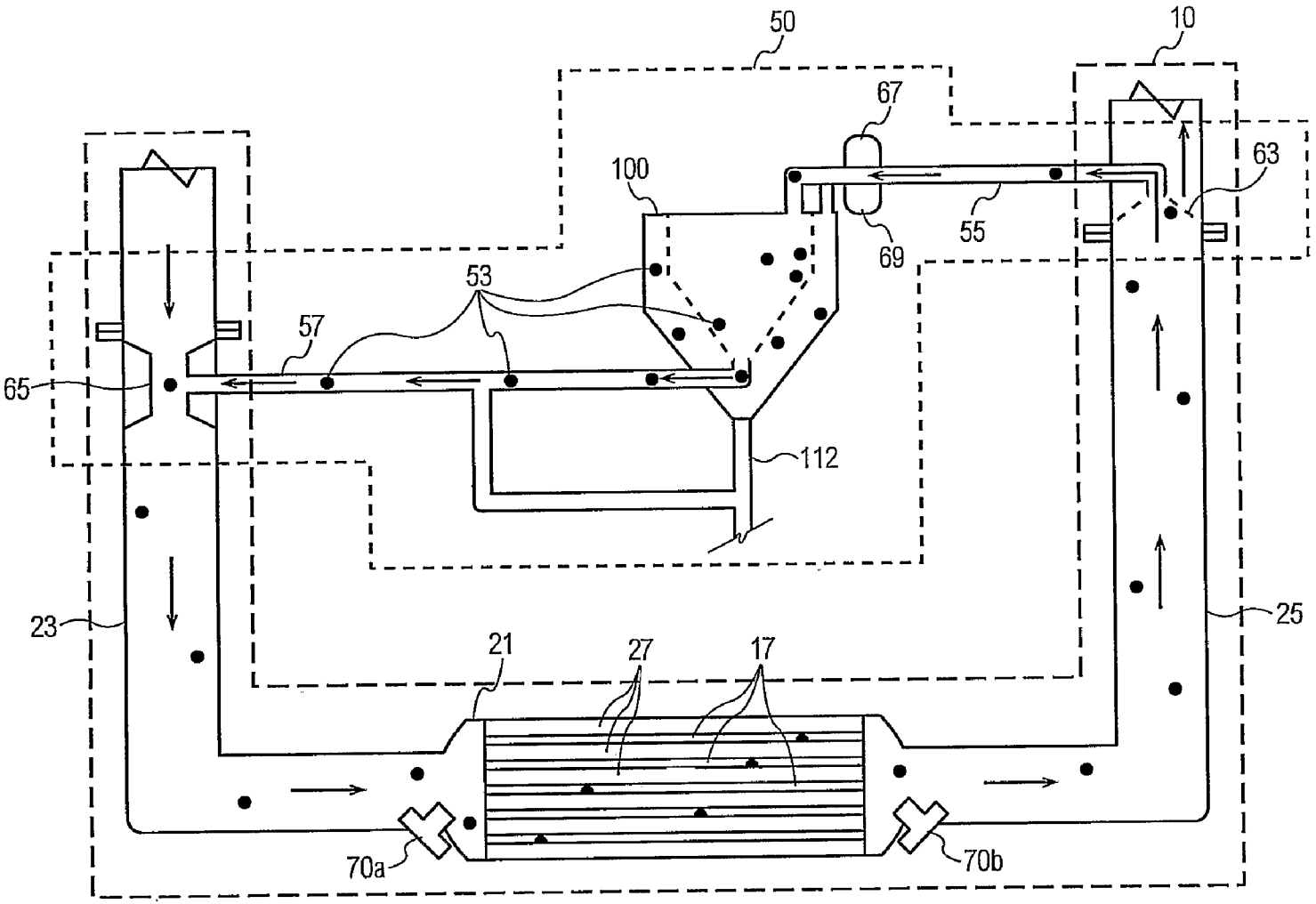
FIG. 1 illustrates a non-powered cleaning system for a fluid heat exchange system in accordance with the present invention.

Referring to FIG. 1, the heat exchange system 10 comprises a plurality of tubes 17 bundled into a heat exchange unit 21 having an inlet end 23 and a discharge end 25. Fluid flows from the inlet end 23 into the tubes 17 of the heat exchange unit 21 and exchanges heat energy with another fluid medium in spaces 27 between the tubes 17 and the walls of the heat exchange unit 21. The fluid then flows out from the tubes 17 into the discharge end 25 of the heat exchanger system 10. A circulating pump (not shown) is generally used to generate pressure differential required for circulating the fluid in the heat exchange system 10. This pressure differential is also used to drive the cleaning system of the present invention.

The cleaning system 50 in accordance with the present invention comprises a plurality of balls 53 circulating in the fluid of the heat exchange system 10, a ball inlet 55, a ball outlet 57, and a dual hull cyclone 100. The balls 53 in the fluid are generally of a predetermined diameter suitable for cleaning the tubes 17 in the heat exchange unit 21. While the balls 53 may be made of a variety of elastomeric materials, almost any resilient material may be utilized. Furthermore, each of the balls 53 used in the present invention utilizes a asymmetrical weighted core for manipulating and modifying the specific gravity of each of the balls 53.

A ball divertor unit 63 installed at the discharge end 25 would collect the balls 53 after they have passed through the tubes 17. The balls 53 together with the fluid would then enter into the dual hull cyclone 100 through the ball inlet 55 coupled to the ball divertor unit 63. The ball divertor unit 63 may simply be a mesh or a basket directing the balls into the ball inlet 55 while still allowing flow of fluid.

The dual hull cyclone 100 advantageously serves to separate balls 53 below a predetermined diameter from balls 53 larger than the predetermined diameter. The dual hull cyclone 100 also serves to dislodge debris accumulated on the balls 53 into the fluid and also simultaneously separate the debris from the fluid.

The balls 53 larger than the predetermined diameter are sent through the ball outlet 57 into the inlet end 23 of the heat exchange system 10. These balls 53 now free from accumulated debris are then recirculated and passed through the tubes 17 again to clean the tubes 17.

The balls 53 smaller than the predetermined diameter may be held within the dual hull cyclone 100 and later discharged from the cleaning system 50 for disposal.

The dual hull cyclone 100 in addition to the separation of worn-out balls 53 from balls 53 larger than the predetermined diameter also advantageously serves to dislodge debris from the balls 53 and separate debris from the fluid. The dual hull cyclone 100 further causes fluid entering the dual hull cyclone 100 to increase in velocity and exit the dual hull cyclone 100 at a much higher velocity. This creates low pressure in the region of the fluid leaving the dual hull cyclone 100 and a pressure differential across the dual hull cyclone 100.

The ball inlet 55 is generally sited such that the ball inlet 55 is of a higher elevation than the dual hull cyclone 100. This results in additional potential pressure head between the ball inlet 55 and the dual hull cyclone 100. This pressure head together with the low pressure in the region of the fluid leaving the dual hull cyclone 100 results in a large pressure differential. This pressure differential is then the force that drives and pushes the balls 53 within the dual hull cyclone 100 and out via the ball outlet 57. Under certain insufficient pressure differential circumstances, an auxiliary pump (not shown) is provided at strategic position within the heat exchange system 10 to enhance balls 53 retrieval and injection processes into the heat exchange system 10.

The ball outlet 57 is coupled to the inlet end 23 of the heat exchange system 10. Installing a venturi 65 at the inlet end 23 where the ball outlet 57 is coupled can further create additional pressure differential. The venturi 65 causes a constriction in the flow of fluid at the venturi 65. The venturi 65 increases the fluid velocity and results in a region of low pressure. This produces a "suction" effect that further facilitates the fluid and balls 53 to exit the ball outlet 57 and enter into the inlet end 23 of the heat exchange system 10. This decrease in pressure in the venturi 65 further contributes to the overall pressure differential between the ball inlet 55 and the ball outlet 57.

The cleaning system 50 may further be enhanced by the installation of ball counter 67 and ball speed tracker 69. The ball counter 67 ensures that the optimum number of balls 53 is kept in circulation within the cleaning system 50 for optimum cleaning performance. As balls 53 are worn-out and removed by the dual hull cyclone 100 when they are below the predetermined diameter, the ball counter 67 would ensure that if too many balls 53 are removed, an alarm would be sounded and operational staff notified or if the system is fully automated, new balls 53 are automatically added into the cleaning system 50.

The ball speed tracker 69 tracks the speed of the balls 53 within the cleaning system. The speed may be used as an indication of the rates of circulation and performance within the cleaning system 50.

The ball counter 67 and ball speed tracker 69 may be magnetic devices. As such the balls 53 being tracked would need to comprise some metallic component. The balls 53 used in the present invention may each be described to comprise a asymmetrical weighted core. This weighted core may be made of metal suitable for the ball counter 67 and ball speed tracker 69 to track and monitor the balls 53.

The asymmetrical weighted core in the balls 53 further allows the relative density of the balls 53 to be advantageously manipulated. Having balls 53 with asymmetrical weighted cores of different masses and sizes allow the balls 53 to have different relative densities and therefore exhibit random dynamic cleaning efficiency. It is advantageous for balls 53 to have different relative densities when the heat exchange unit 21 and the tubes 17 are in a horizontal orientation. The balls 53 having different relative densities would then tend to enter different tubes 17 at different heights as their different relative densities would tend to keep them at different depths in the fluid. This increases the probability of more tubes 17 being cleansed by the balls 53 having different relative densities. The asymmetrical weighted core balls 53 of smaller diameter than the internal diameter of tubes 17 exhibit random dynamic collision within the tubes 17, hence giving rise to better efficiency in cleaning and prolonging the useful life span of the balls 53.

Inspection means 70*a*, 70*b* may further be installed to monitor the open ends of the tubes 17 of the heat exchange unit 21. The inspection means 70*a*, 70*b* are primarily for monitoring the open ends of the tubes 17 to check if they are visibly choked. They may further be used to ensure that the balls 53 used are effectively cleaning a substantial number of the tubes 17 within the heat exchange unit 21.

Figure 2:
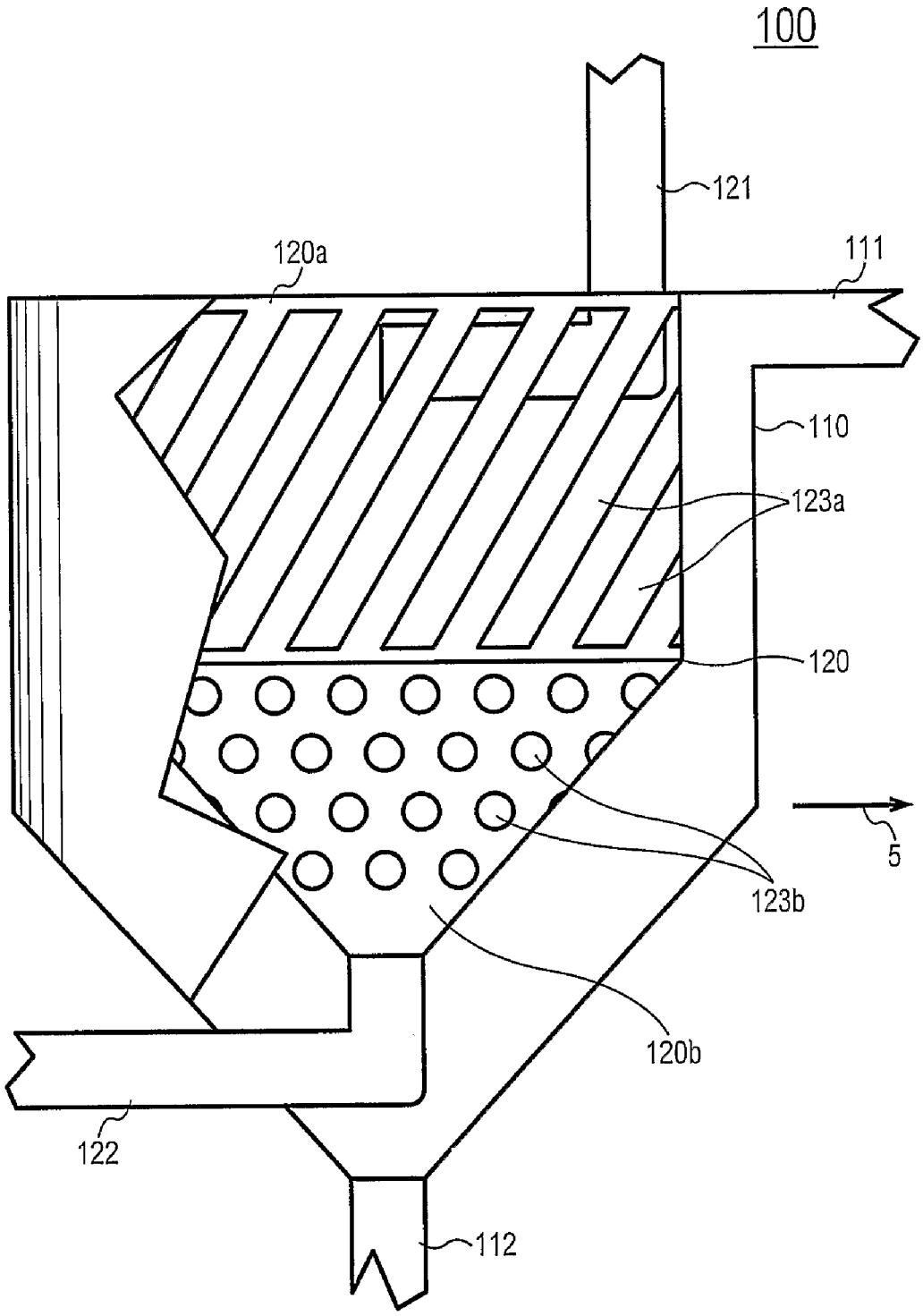
FIG. 2 illustrates a cut-away view of a dual hull cyclone of FIG. 1.

Referring to FIG. 2, the dual hull cyclone 100 comprises a primary cyclone 110 and a secondary cyclone 120, where the secondary cyclone 120 is disposed inside the primary cyclone 110. A primary inlet 111 directs fluid into the primary cyclone 110 and a secondary inlet 121 directs fluid into the secondary cyclone 120. Both the primary inlet 111 and the secondary inlet 121 are also coupled to the ball inlet 55. The secondary inlet 121 is also adapted to allow the balls 53 to enter into the secondary cyclone 120. The primary inlet 111 and the secondary inlet 121 are both adapted to direct fluid tangentially into the primary cyclone 110 and the secondary cyclone 120 respectively.

The primary cyclone 110 further has a primary outlet 112 coupled to the ball outlet 57 for the passage of fluid leaving the primary cyclone 110. The primary outlet 112 further serves to allow balls 53 below the predetermined diameter to exit the primary cyclone 110. The secondary cyclone 120 similarly has a secondary outlet 122 for the passage of fluid leaving the secondary cyclone 120. The secondary outlet 122 serves also to remove balls larger than the predetermined diameter from the secondary cyclone 120 and direct them back into circulation in the cleaning system 50 via the ball outlet 57.

The primary cyclone 110 may be utilized to act as a storage means for storing balls 53 below the predetermined diameter where the balls 53 which have been retired would then be discharged from the cleaning system 50.

The secondary cyclone 120 further comprises a first cylindrical section 120*a* communicably coupled to a conical section 120*b*. Both the first cylindrical section 120*a* and the conical section 120*b* are further adapted with a plurality of apertures 123*a*, 123*b*. The plurality of apertures 123*a*, 123*b* are of a predetermined shape and size, allowing balls 53 below the predetermined diameter to pass through into the primary cyclone 110. In effect the secondary cyclone 120 induces the balls 53 smaller than the predetermined diameter towards and into the primary cyclone 110. Simultaneously, the balls 53 larger than the predetermined diameter are retained within the secondary cyclone 120 and are allowed to exit by the secondary outlet 122 back into the cleaning system 50 via ball outlet 57.

The apertures 123*a* of the first cylindrical section 120*a* are in the shape of slots arranged all round the first cylindrical section 120*a*. The slots are arranged at an angle of about 30° to 60° from the horizontal of the dual hull cyclone 100; the horizontal being denoted by arrow 5 in FIG. 2. The width of the slots determines the diameter of the balls 53 that can pass through, and the angle of the slots assists in the balls 53 being subjected to random contact with the slots and enabling the balls 53 to pass through if the diameter of the balls 53 are below the predetermined diameter.

The apertures 123*b* of the conical section 120*b* of the secondary cyclone 120 are substantially circular holes. The circular holes are arranged in a predetermined manner all round the conical section 120*b*. Similarly, the size of the circular holes also determines the diameter of the balls 53 that can pass through.

Figure 3:
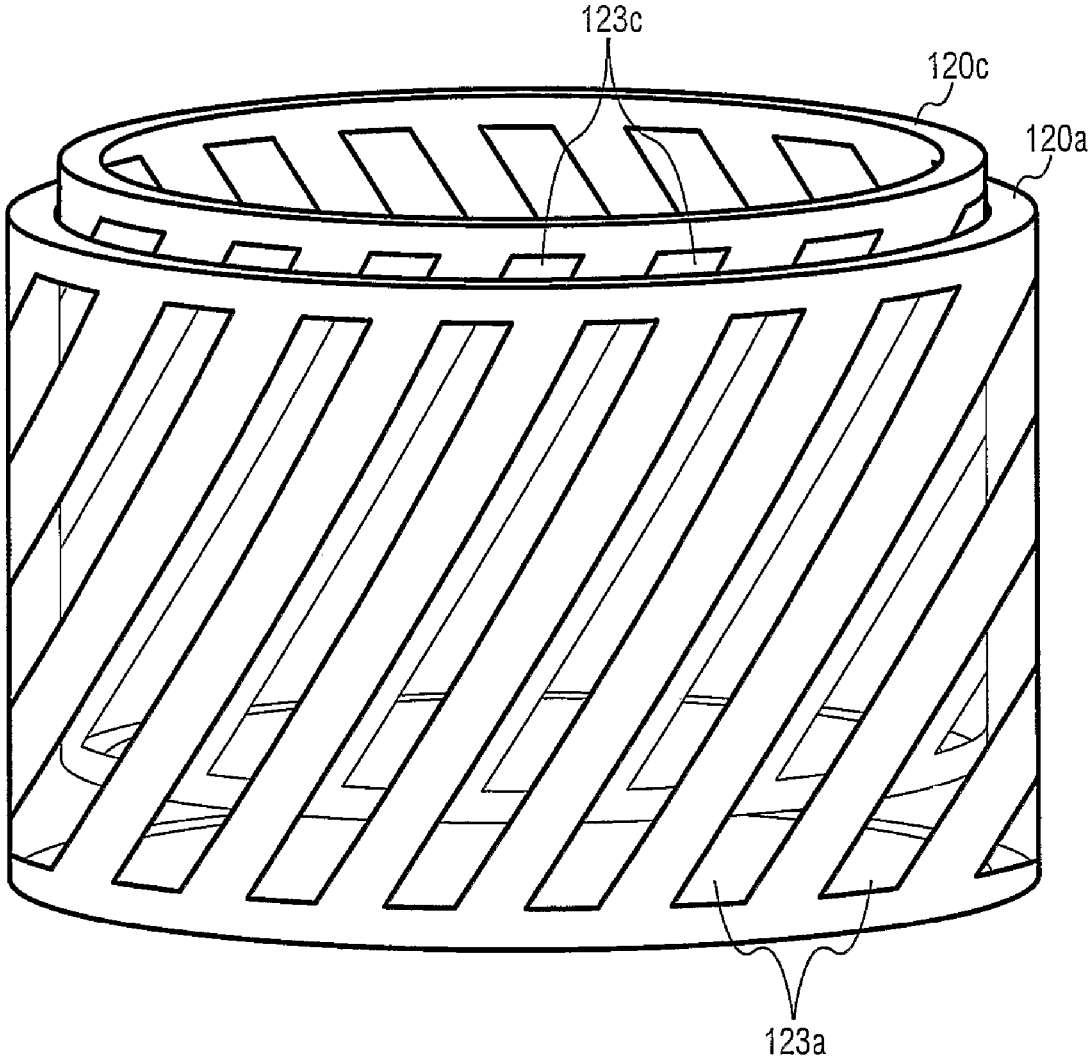
FIG. 3 illustrates a first and second cylindrical section of FIG. 2.

Referring to FIG. 3, the first cylindrical section 120*a* is further adapted to allow a variation of the width of the apertures 123*a*. This allows for a change in the predetermined diameter of the balls 53 that can pass through the slots. The first cylindrical section 120*a* further comprises a second cylindrical section 120*c* which fits inside the cylindrical section 120*a*. The second cylindrical section 120*c* being substantially configured with similar apertures 123*c* as the first cylindrical section 120*a*. The second cylindrical section 120*c* further being adapted to be adjustable. Adjusting the second cylindrical section 120*c* causes variation of the width of the aperture 123*a* of the first cylindrical section 120*a*. This happens as part of the walls of the second cylindrical section 120*c* which have no apertures 123*c* are adapted to overlap into the apertures 123*a* of the first cylindrical section 120*a*, thus decreasing the width of the apertures 123*a*.

Alternatively, the second cylindrical section 120*c* may be fixed while the first cylindrical section 120*a* is adapted to be adjustable. In yet another alternative, both the first cylindrical section 120*a* and the second cylindrical section 102*b* may be adapted to be adjustable. The intent is mainly in having the option to vary the width of the apertures 123*a* of the first cylindrical section 120*a*

Figure 4:
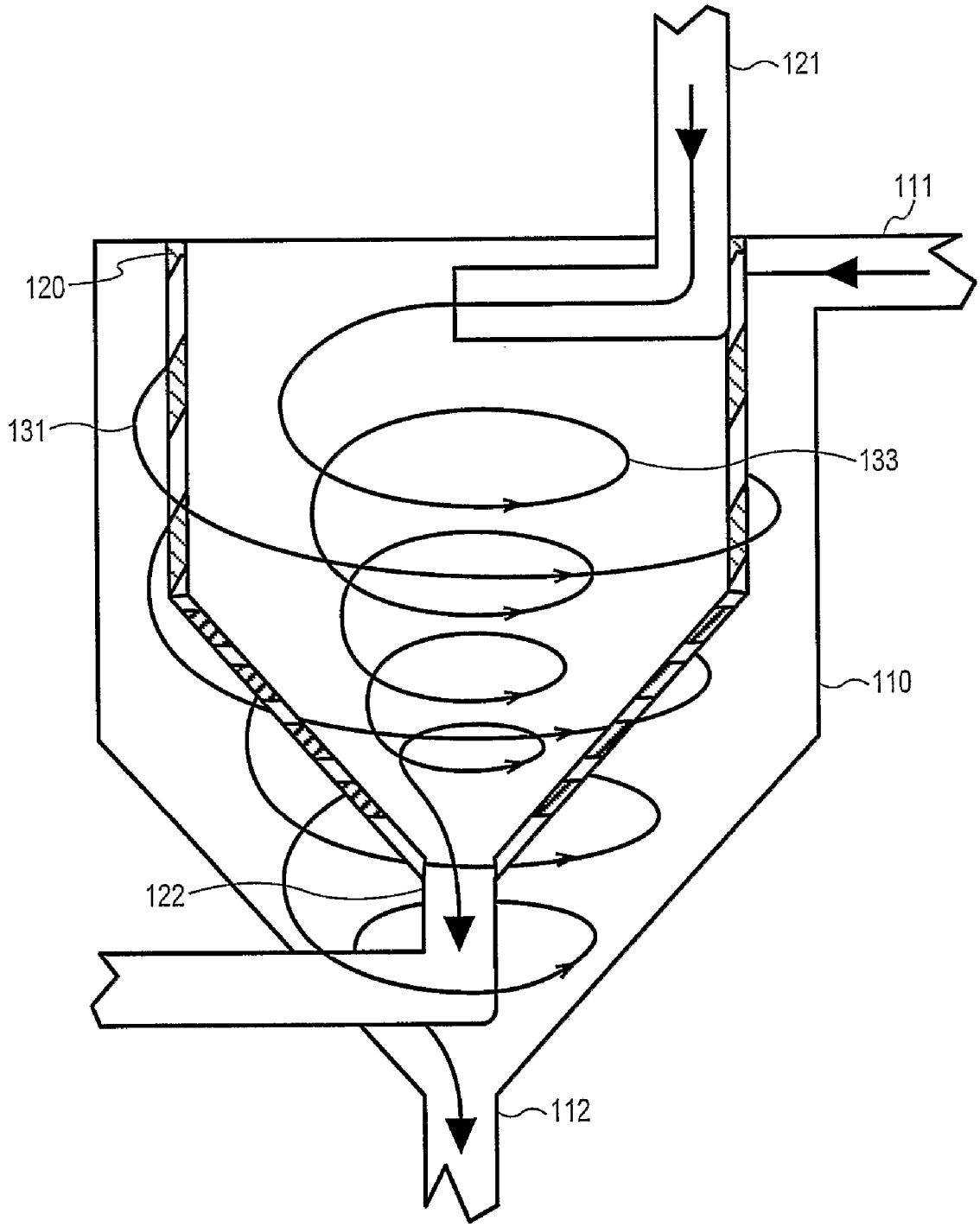
FIG. 4 illustrates a cross-sectional operational view of FIG. 2.
Figure 5:
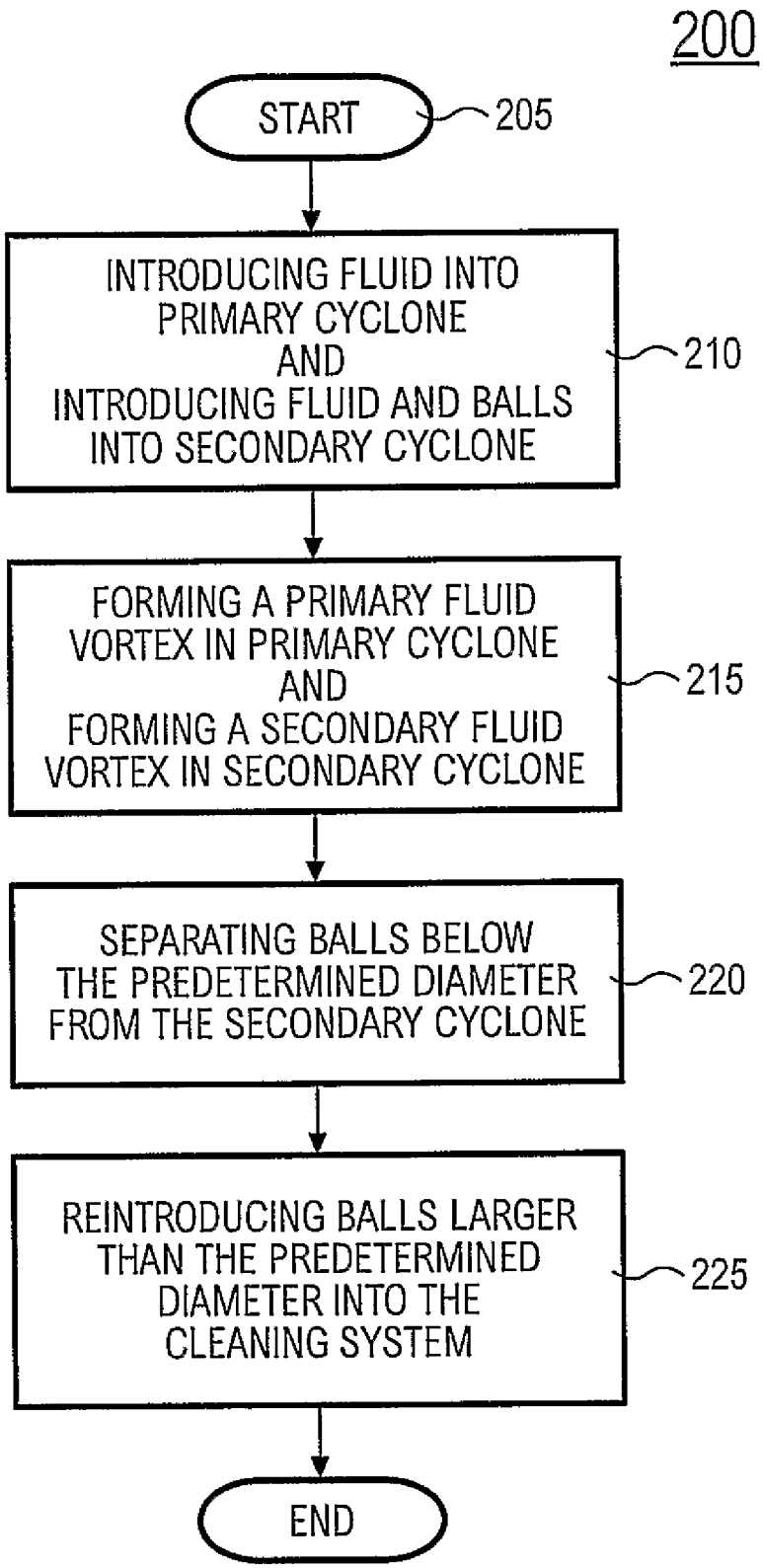
FIG. 5 illustrates a flowchart for a method of operation in accordance with the present invention.

Referring to FIG. 4 and FIG. 5 the method for operation of the dual hull cyclone 100 starts with the step of introducing 210 fluid containing balls 53 into the dual hull cyclone 100 via the secondary inlet 121 into the secondary cyclone 120, and introducing fluid only into the dual hull cyclone 100 via the primary inlet 111 into the primary cyclone 110.

Following which, a primary fluid vortex 131 and a secondary fluid vortex 133 are simultaneously formed 215 in the primary cyclone 110 and the secondary cyclone 120 respectively.

The fluid in the primary fluid vortex 131 and secondary fluid vortex 133 are both experiencing centrifugal forces which would cause separation of bodies or objects having different relative densities. This separation capability in cyclones is well-known in the art and will not be further discussed in detail.

Fluid containing balls 53 in the secondary fluid vortex 133 would undergo separation of the balls 53 from the fluid. As centrifugal forces act on the fluid and balls 53, the balls 53 which are denser than the fluid would migrate to the walls of the secondary cyclone 120 and come into contact with the walls. The contact between the secondary cyclone 120 and the balls 53 causes debris accumulated on the balls 53 to break free into the fluid. The spinning action of the secondary fluid vortex 133 may further add to the dislodging of debris from the balls 53. The balls 53 while spinning inside the secondary cyclone 120 may further come into contact and collide with each other and add to the dislodging of debris from the balls 53. Debris dislodged from the balls 53 may then migrate through the apertures 123*a*, 123*b* into the primary cyclone 110 and be discharged through the primary outlet 112 for disposal.

As the balls 53 migrate to the walls of the secondary cyclone 120, the step of separation 220 of balls 53 below the predetermined diameter from the secondary cyclone 120 occurs. The balls 53 below the predetermined diameter would pass through the plurality of apertures 123*a*, 123*b* of the secondary cyclone 120 into the primary cyclone 110 to be retired from the cleaning system 50. The balls 53 below the predetermined diameter then exit the primary cyclone 110 via the primary outlet 112. The retired balls 53 would then settle into a collecting means for disposal while the fluid may be reintroduced into the cleaning system 50.

The balls 53 larger than the predetermined diameter would be retained inside the secondary cyclone 120 and would exit the secondary cyclone 120 via the secondary outlet 122 to be reintroduced 225 back into the cleaning system 50 via ball outlet 57.

Figure 6:
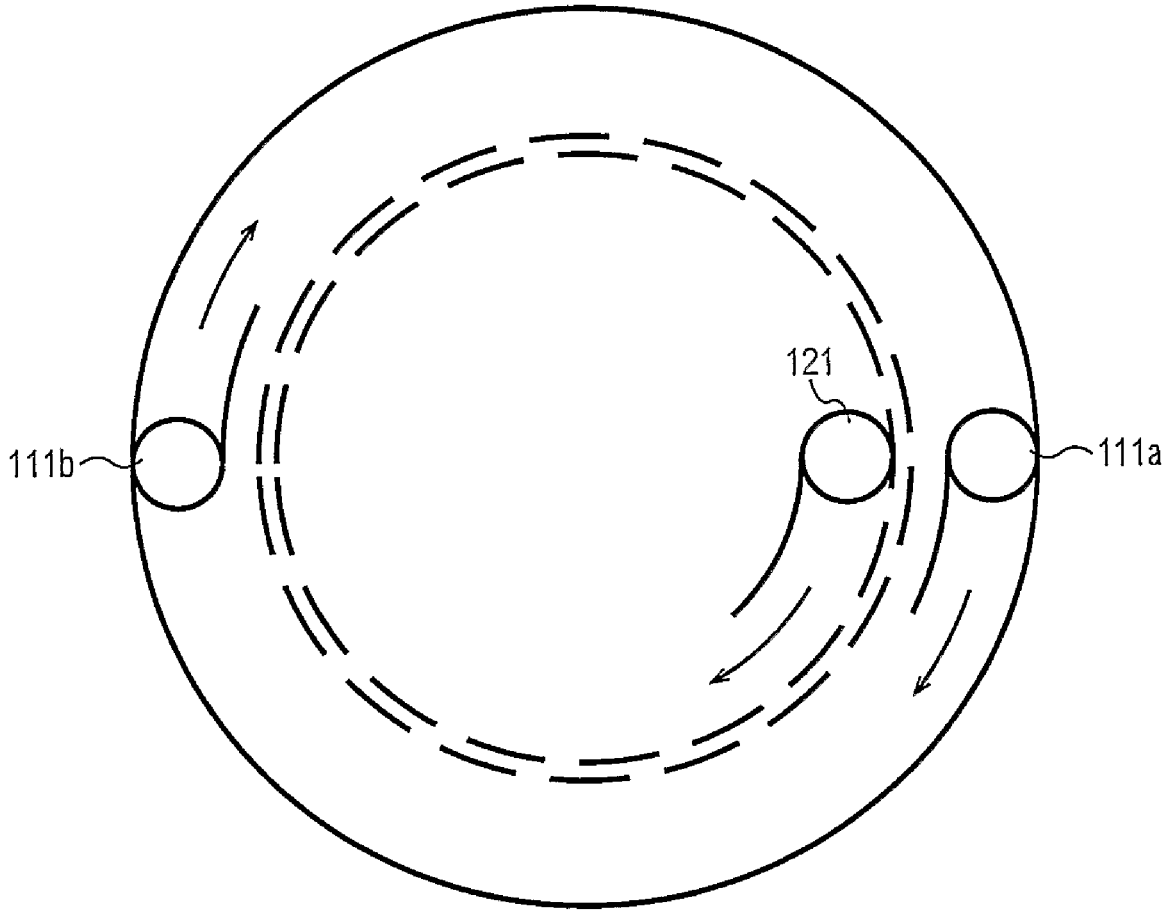
FIG. 6 illustrates a cut-away view of the top of FIG. 2.

Referring to FIG. 6, the primary inlet 111 and the secondary inlet 121 may further be adapted to improve the performance of the dual hull cyclone 120 in accordance with the present invention. The primary inlet 111 may be adapted to be inclined by a small angle of less than 15° from the horizontal as denoted by the arrow 5 in FIG. 2 into the primary cyclone 110. The primary inlet 111 may further be adapted to include a choke for varying the size of the primary inlet 111 thereby varying the velocity of the fluid entering into the primary cyclone 110.

The primary inlet 111 may also be further adapted to comprise two primary inlets 111*a*, 111*b* situated at opposing sides within the primary cyclone 110. The primary inlets 111*a*, 111*b* may also be adapted for varying the velocity of the fluid entering the primary cyclone 110. In accordance with the present invention, fluid velocity in the primary cyclone 110 is higher than the fluid velocity in the secondary cyclone 120. This causes a differential pressure between the primary cyclone 110 and the secondary cyclone 120. Higher fluid pressure within the secondary cyclone 120 then aids in the separation capability of the dual hull cyclone 100 as forces caused by the pressure differential is directed from the secondary cyclone 120 to the primary cyclone 110.

The primary inlets 111*a*, 111*b* and the secondary inlet 121 are adapted to substantially follow the curve structure of the cyclones, thus directing the fluid circumferentially into the dual hull cyclone 100.

It will be appreciated that various modifications and improvements can be made by a person skilled in the art without departing from the scope of the present invention.

What is claimed is:

1. A non-powered cleaning system for cleaning a plurality of tubes in a heat exchange system having an inlet end and a discharge end, where a fluid is used as a heat exchange medium, the fluid flowing from the inlet end into the plurality of tubes to the discharge end, the cleaning system comprising:

a plurality of balls in the fluid;

a ball inlet coupled to the discharge end which introduces the fluid and the plurality of balls into the cleaning system;

a ball divertor unit coupled to the ball inlet which directs the plurality of balls and fluid into the ball inlet;

a dual hull cyclone coupled to the ball inlet tangentially, producing a spiraling motion of the fluid, which separates a plurality of balls below a predetermined diameter from the plurality of balls and which separates debris from the fluid by centrifugal force; and a ball outlet coupled to the dual hull cyclone which introduces the plurality of balls after separation and fluid into the inlet end of the heat exchange system;

wherein the dual hull cyclone comprises a primary cyclone and a secondary cyclone; the secondary cyclone of the dual hull cyclone having a plurality of apertures of a predetermined shape and size, and the secondary cyclone further being disposed within the primary cyclone, the apertures causing objects to pass from the secondary cyclone to the primary cyclone.

2. The system in accordance with claim 1, further comprising a venturi installed at the inlet end for increasing pressure differential between the outlet end and the discharge end.

3. The system in accordance with claim 1, wherein each of the plurality of balls is adapted to comprise an asymmetrical weighted core.

4. The system in accordance with claim 3, wherein the asymmetrical weighted core is made of metal.

5. The system in accordance with claim 3, wherein the plurality of balls have asymmetrical weighted cores of a variety of masses and sizes resulting in a variety of relative densities.

6. The system in accordance with claim 1, further comprising a ball speed tracker for monitoring the speed of the plurality of balls within the system.

7. The system in accordance with claim 1, further comprising a ball counter for tracking the number of the plurality of balls within the system.

8. The system in accordance with claim 7, wherein the ball counter is a magnetic device for operating with balls having a asymmetrical weighted metallic core.

9. The system in accordance with claim 8, wherein the ball speed tracker is a magnetic device for operating with balls having a asymmetrical weighted metallic core.

10. The system in accordance with claim 1 further comprising inspection means at open ends of the plurality of tubes for inspecting condition of the plurality of tubes.

11. The system in accordance with claim 2, further comprising an auxiliary pump provided at strategic position within the heat exchange system to enhance balls retrieval and injection processes into the heat exchange system.

12. A dual hull cyclone which separates balls below a predetermined diameter from a plurality of balls in a non-powered cleaning system for cleaning a plurality of tubes in a heat exchange system, where a fluid is used as a heat exchange medium, the dual hull cyclone comprising:

a primary cyclone;

a secondary cyclone disposed within the primary cyclone and having a plurality of apertures of a predetermined shape and a predetermined size;

a primary inlet directing fluid tangentially into the primary cyclone so as to produce a spiraling motion of the fluid; and a secondary inlet directing fluid containing the plurality of balls tangentially into the secondary cyclone, the secondary inlet being a tube;

wherein the secondary cyclone separates balls below a predetermined diameter from the plurality of balls and separates debris from the fluid by centrifugal force.

13. The dual hull cyclone in accordance with claim 12, wherein the secondary cyclone further comprises a first cylindrical section and a conical section.

14. The dual hull cyclone in accordance with claim 13, wherein the plurality of apertures of the first cylindrical section further comprises a plurality of slots.

15. The dual hull cyclone in accordance with claim 14, wherein the plurality of slots are arranged at an angle of about 30° to 60° from the horizontal.

16. The dual hull cyclone in accordance with claim 12, wherein the plurality of apertures of the conical section comprises a plurality of substantially circular holes.

17. The dual hull cyclone in accordance with claim 12, wherein the secondary cyclone further comprises a second cylindrical section substantially similar to the first cylindrical section disposed inside the first cylindrical section wherein displacing the second cylindrical section allows the variation of the size of the plurality of apertures of the first cylindrical section.

18. The dual hull cyclone in accordance with claim 12, wherein the secondary cyclone further comprises a second cylindrical section substantially similar to the first cylindrical section disposed inside the first cylindrical section wherein displacing the first cylindrical section allows the variation of the size of the plurality of apertures of the first cylindrical section.

19. The dual hull cyclone in accordance with claim 12, wherein the primary inlet further comprises two primary inlets sited at opposing sides of the primary cyclone.

20. The dual hull cyclone in accordance with claim 12, wherein the primary inlet is adapted for varying the velocity of fluid entering the primary cyclone.

21. The dual hull cyclone in accordance with claim 12, wherein the primary inlet and the secondary inlet are adapted to direct fluid circumferentially into the primary and secondary cyclone respectively.

22. A method for separating a plurality of balls below a predetermined diameter from a plurality of balls in a non-powered tube cleaning system, using a dual hull cyclone having a primary cyclone, a secondary cyclone disposed within the primary cyclone and having a plurality of apertures of a predetermined shape and a predetermined size; wherein the secondary cyclone allows the plurality of balls below the predetermined diameter to pass through the plurality of apertures into the primary cyclone, the method comprising the steps:

a) introducing fluid containing the plurality of balls tangentially into the secondary cyclone so as to produce a spiraling motion of the fluid;

b) forming a secondary fluid vortex in the secondary cyclone; and c) separating the plurality of balls below the predetermined diameter from the secondary cyclone into the primary cyclone by centrifugal force.

23. The method in accordance with claim 22, further comprising the step of reintroducing the plurality of balls after separation into the tube cleaning system.

24. The method in accordance with claim 22, wherein step c) further comprising the steps:

c1) dislodging debris from the plurality of balls; and c2) separating debris from the plurality of balls into the primary cyclone by centrifugal force.

* * * * *

UNITED STATES PATENT AND TRADEMARK OFFICE

CERTIFICATE OF CORRECTION

PATENT NO. : 7,735,545 B2
APPLICATION NO. : 11/572208
DATED : June 15, 2010
INVENTOR(S) : Kok Heng Alex Chow It is certified that error appears in the above-identified patent and that said Letters Patent is hereby corrected as shown below:

Column 8, Line 37, delete "claim 8", and replace with -- claim 6 --.

Signed and Sealed this
Twenty-second Day of March, 2011

David J. Kappos

David J. Kappos
*Director of the United States Patent and Trademark Office*